United States Patent [19]

Rosar et al.

[11] Patent Number: 4,815,790

[45] Date of Patent: Mar. 28, 1989

[54] NAHCOLITE SOLUTION MINING PROCESS

[75] Inventors: Edward C. Rosar, Lakewood; Roger L. Day, Rifle, both of Colo.

[73] Assignee: NaTec, Ltd., Houston, Tex.

[21] Appl. No.: 193,920

[22] Filed: May 13, 1988

[51] Int. Cl.[4] ..... E21B 43/28; E21B 43/30; E21B 43/40

[52] U.S. Cl. ..... 299/4; 166/245; 166/263; 299/5; 299/7

[58] Field of Search ..... 166/245, 263, 271, 272, 166/303; 299/4, 5, 7; 423/206 T, 208

[56] References Cited

U.S. PATENT DOCUMENTS

| | | | |
|---|---|---|---|
| 2,388,009 | 10/1945 | Pike | 299/5 X |
| 3,700,280 | 10/1972 | Papadopoulos et al. | 299/5 |
| 3,759,328 | 9/1973 | Ueber et al. | 166/303 |
| 3,759,574 | 9/1973 | Beard | 299/4 |
| 3,779,602 | 12/1973 | Beard et al. | 299/5 |
| 3,792,902 | 2/1974 | Towell et al. | 299/5 |
| 3,953,073 | 4/1976 | Kube | 299/5 |
| 3,967,853 | 7/1976 | Closmann et al. | 299/4 |
| 4,249,777 | 2/1981 | Morrell et al. | 299/4 |
| 4,283,372 | 8/1981 | Frint et al. | 299/5 X |
| 4,375,302 | 3/1983 | Kalmar | 299/4 |

*Primary Examiner*—George A. Suchfield

*Attorney, Agent, or Firm*—The Dulin Law Firm

[57] ABSTRACT

Nahcolite solution mining process comprising drilling at least one well into a Nahcolite bed, circulating hot barren aqueous liquor in a cavity in said Nahcolite bed for a time sufficient to produce a pregnant liquor having an increase in the concentration of $NaHCO_3$ in the range of from about 3 to about 20% while maintaining $Na_2CO_3$ concentration in the range of about 0.25–4%, preferably less than 2.5%, withdrawing said pregnant liquor, cooling said pregnant liquor to preferentially precipitate $NaHCO_3$ therefrom and to produce a barren liquor, recovering said $NaHCO_3$, and reheating and re-injecting said barren liquor in said well. The cavity temperature is maintained below about 250° F. and preferably below about 200° F. The barren liquor is injected at a pressure of below about 150 psig. The pregnant liquor is extracted at a temperature in the range of from about 85° F. to about 200° F., and the cystallization occurs at a temperature of about 25°–120° F. The NaCl concentration is maintained at below about 6% and preferably below about 1.0%. Crystalline sodium bicarbonate of high purity (98+% $NaHCO_3$) is produced in the as-crystallized form, and simple washing increases the purity.

46 Claims, 3 Drawing Sheets

LOCATION OF MINING ZONE WITHIN BOIES BED

MINING CAVITY LAYOUT

NAHCOLITE SOLUTION MINING PROCESS

FIELD

The invention relates to a process for solution mining of bedded Nahcolite and Nahcolitic oil shale by use of hot aqueous liquor under superatmospheric pressure in the absence of steam to produce an aqueous pregnant liquor having a supersaturated concentration of sodium bicarbonate from which high quality sodium bicarbonate can be produced by crystallization techniques. The resultant sodium bicarbonate can be dried and provided as the end product, calcined to produce very light soda ash ($Na_2CO_3$), or wetted and re-calcined to produce medium dense or dense soda ash.

BACKGROUND

Sodium bicarbonate is an important industrial chemical useful in water and air pollution control, various industrial processes, and in higher grades as an agricultural feed additive and component of foods.

There are three basic processes for production or recovery of bicarbonate: (1) The carbonation of naturally or synthetically-produced sodium carbonate solutions; (2) crystallization of a naturally occurring or by-product sodium bicarbonate solution; and (3) carbonation of ammonium carbonate and reacting with sodium chloride. A natural sodium carbonate is carbonated to produce sodium bicarbonate by Kerr-McGee at Searles Lake, Calif., ICI in Africa and a Mexican plant near Mexico City. Synthetic or naturally produced sodium carbonate is carbonated to produce sodium bicarbonate by Church and Dwight Company in New York, Ohio and Wyoming, by Stauffer Chemicals Company in Illinois and by Riverside Products Company in Georgia. ICI in England, Allied Chemical in Canada and Solvay in Western Europe employ the ammonium bicarbonate/sodium chloride process to produce synthetic sodium bicarbonate.

Natural sodium bicarbonate has been crystallized by Dennison Resources in Australia. The process, involving carbonation of natural sodium carbonate solutions, is practical because the sodium carbonate solution is usually a saturated brine solution containing a variety of sodium salts. The solubility of sodium bicarbonate is greatly depressed by the presence of sodium chloride, sodium sulfate or other salts. In such brines, the sodium carbonate concentration is typically 3–7% by weight. The resulting sodium bicarbonate solubility is typically only 1–2% by Thus a 5% sodium carbonate solution may be carbonated to a 0.5% sodium carbonate/7.15% sodium bicarbonate solution; 85% of the bicarb precipitates, and 82% sodium carbonate recovery is realized.

There are vast quantities of Nahcolite deposits in the Piceance Creek Basin in Northwestern Colorado, which deposits are in the form of beds and disseminated crystals in the Saline Zone of the Green River formation. This zone is more well known for the presence of large quantities of oil shale. The entire zone ranges on the order of 1,000 feet thick with relatively high concentrations of kerogen capable of producing from 12 to 30 gallons of oil per ton. Interbedded in the formation are beds and zones of disseminated crystals of various sodium minerals, including Halite (NaCl), Nahcolite, Dawsonite, and Wegeschiderite.

U.S. Pat. No. 3,779,602 of Beard et al. (Shell Oil Co.) proposes to solution mine sodium bicarbonate minerals from an oil shale formation by injecting steam at the top of a predominantly steam-filled cavity at a temperature greater than 250° F., and maintaining the cavity temperature greater than 250° F., preferably greater than 300° F. to maximize cavity growth rate. Condensation of steam to a liquid form is said to occur on contact with the formation resulting in collection of superheated water in the lower portion of the cavity. The pressure is adjusted and maintained to an optimum pressure at which the sodium-carrying capacity of the superheated water at the selected high temperature is a maximum. Below this pressure there will be excess thermal decomposition of bicarbonate to carbonate and precipitation of carbonate. Above this pressure conversion of bicarbonate to carbonate is inhibited and the mineral-carrying capacity of the leaching fluid is reduced. The aim is to remove the most sodium mineral per gallon, and this perforce is a mixture of sodium bicarbonate and carbonate. At 400° F. the patent calls for a cavity pressure of 1000 psi. The cavity growth is predominantly temperature dependant, the patent in Col. 21 66–67 stating "cavity growth rate is only slightly dependant on rate of fluid injection", due to thermal fracturing of the oil shale surrounding the Nahcolite nodules. Beard has stated publicly that Shell Oil disposed without any processing by down well injection of all sodium solutions produced in the Shell experiments. This Shell patent is directed to a quite different process in a different formation, using pressurized steam in a Nahcolitic oil shale zone containing 20–40% of disseminated nodular Nahcolite crystals, and also containing a few stringers of substantially pure Nahcolite.

Towell et al., of Shell Oil in U.S. Pat. No. 3,792,902 injects hot water of low alkalinity into the base of the production tubing string or adjacent the intake to prevent mineral precipitation and plugging of the production well by dilution. The patent is directed to recovery by solution mining of trona or Nahcolite by use of hot water or steam (for example, at a temperature of 325° F. and pressure of 1500 psi) to produce a mixed $Na_2CO_3$/-$NaHCO_3$-rich production solution. As in Beard 3,779,602 there is a pressure/temperature dependency relationship which in this patent is related to dilution ratio to prevent precipitation in the production tubing. For example, for a 2:1 dilution ratio the dilution fluid is 220° F. to 530° F. while the production fluid is in the range of 300° F.–480° F. Pressures of 500–800 psi are disclosed as the operating range.

Beard of Shell Oil in U.S. Pat. No. 3,759,574 teaches a method producing shale oil from trona and/or Nahcolite mineral bearing oil shale formations which process includes an initial step of permeabilization of the formation by dissolution of the sodium minerals with a hot aqueous solution. Similarly, Kelmar in U.S. Pat. No. 4,375,302, as part of multi-mineral recovery from oil shale, proposes to inject an NaOH solution into oil shale to dissolve $NaHCO_3$ and convert it to an $Na_2CO_3$ solution. This is to develop porosity in the oil shale as a step in preparation for recovery of shale oil via in-situ retorting of rubbed oil shale.

Uber et al. of Shell Oil in U.S. Pat. No. 3,759,328 expands a cavern (e.g. a bore hole) in an oil shale formation by use of steam, hot water or a mixture thereof, to permeabilize and rubble the oil shale rock for subsequent recovery of shale oil through pyrolysis of the kerogen contained in the oil shale. The steam is introduced at the top of the cavern, and the pressure is maintained above the decomposition pressure of the carbonate minerals (trona or Nahcolite). The temperature ranges from above about 250° F. up to 600°–1000° F., i.e. enough to cause a relatively rapid oil shale pyrolysis. Decomposition of the minerals is taught, and shale oil is extracted along with the outflowing fluid from the production pipe. This patent is after the oil, not the sodium minerals.

Papadopoulos et al. of Shell Oil in U.S. Pat. No. 3,700,280 enlarges bore hole "cavern" in oil shale containing low grade Nahcolite (5–40%) and Dawsonite (10–12%) by injecting a hot fluid (steam or hot water) in the upper region of the "cavern" at a temperature hot enough to cause decomposition of the Nahcolite and Dawsonite to form $CO_2$ and water, thereby building up enough pressure to cause fracturing and rubbling of the cavern roof. This is a process of in situ gas fracing by decomposition Nahcolite and Dawsonite. Recovery of $NaHCO_3$ is not taught. This patent, states in passing (column 4, lines 41–44): "Into an oil shale formation rich in Nahcolite and Dawsonite a well was completed at below about 2000 feet and a portion of the Nahcolite bed was water leached to form a cavern. Steam was injected along the cavern roof to decomposition [sic]the Nahcolite and Dawsonite to form carbon dioxide thereby building up pressure and cause upward migration of the cavern roof and oil shale rubbling."

It is known that powdered sodium bicarbonate injected in the flue gas of a power as industrial plant serves as an excellent sorbent for removal of $SO_x$ and $NO_x$ therefrom. The dry powdered sodium bicarbonate is effective in removing $SO_x$ and $NO_x$, while Trona (or sodium sesquicarbonate) is less effective, and sodium carbonate is, practically speaking, ineffective. However, the cost of commercially available sodium bicarbonate is prohibitive.

Thus, there is a great need in the art to provide a low cost source of powdered crystalline sodium bicarbonate for use as an air pollution control sorbent. Only through a development of a process and apparatus for recovery of dissolved sodium bicarbonate from solution-mined Nahcolite deposits can there be made available low cost powdered crystalline sodium bicarbonate for air pollution control sorbents and other conventional sodium bicarbonate uses.

THE INVENTION

OBJECTS

It is among the objects of this invention to provide a process for the in situ solution mining of sodium bicarbonate, and more particularly for a process of solution mining Nahcolite which process does not result in substantial degradation of sodium bicarbonate into sodium carbonate.

It is another object of this invention to provide a process for in situ solution mining of Nahcolite-containing rock or ore involving use of hot water which is pressurized to prevent flashing into steam which has been found to degrade the Nahcolite to sodium carbonate or $CO_2$ and water.

It is another object of this invention to provide a process of in situ solution mining Nahcolite contained in oil shale bearing rock, which process involves use of hot water pressurized to prevent formation of steam which would cause the extraction of kerogen from the host oil shale rock, thus contaminating the product pregnant liquor solution with liquid and gaseous hydrocarbons.

It is another object of this invention to provide a process for solution mining of sodium bicarbonate from Nahcolite-bearing rock followed by the crystallization of sodium bicarbonate from the pregnant liquor produced in the solution mining process.

It is another object of this invention to provide a process of in situ solution mining of Nahcolite to produce high grade sodium bicarbonate (98+% $NaHCO_3$) and various grades of soda ash, including very light ash, light to medium density ash, and dense soda ash.

Still further other objects will be evident from the specification, drawings and claims appended hereto.

DRAWINGS

The invention is illustrated in more detail in the drawings in which.

SUMMARY

Figure 1:
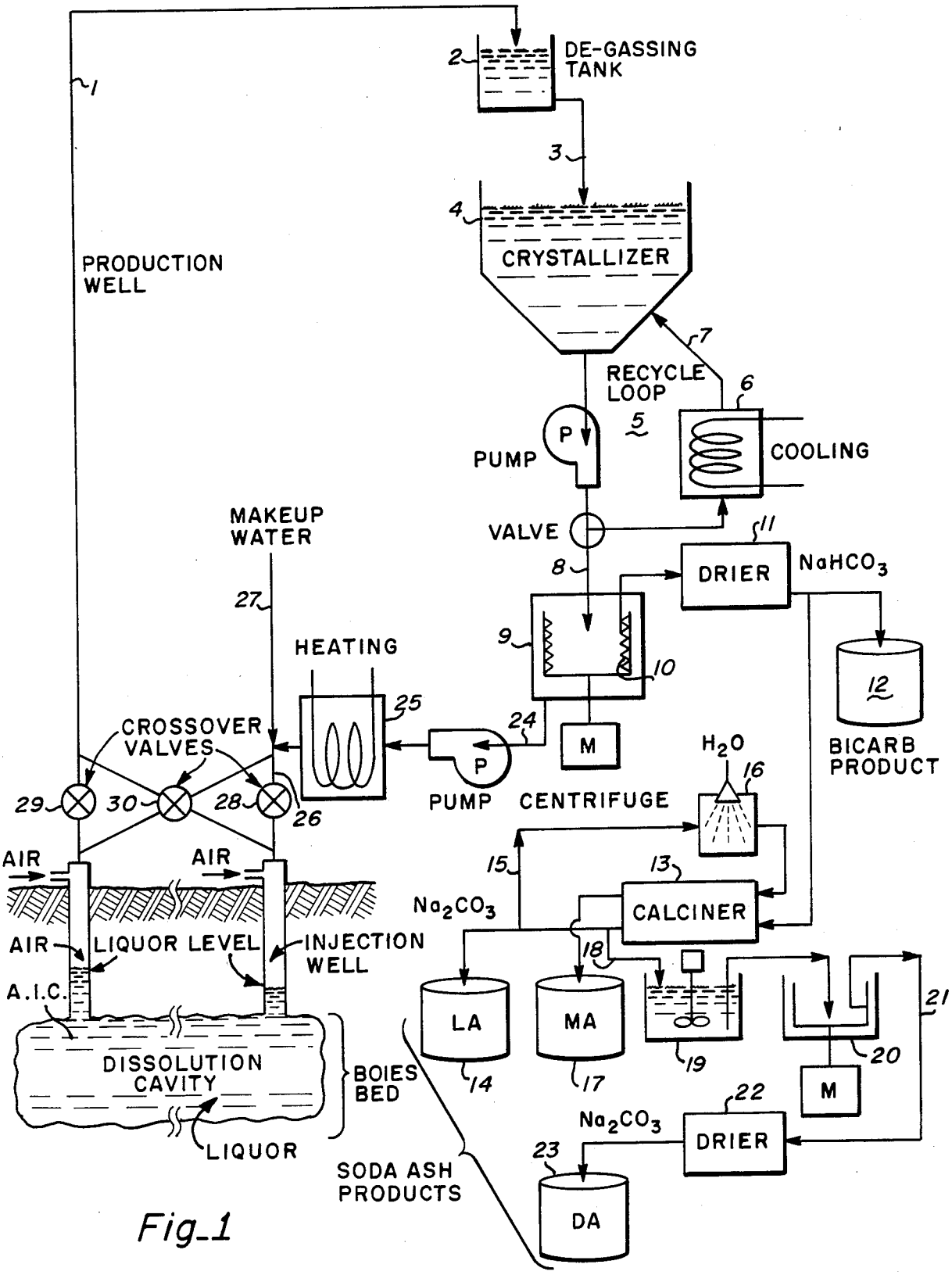
FIG. 1 is a schematic flow sheet showing the solution mining process followed by crystallization of sodium bicarbonate therefrom in accord with this invention for the production of high quality crystalline sodium bicarbonate and various types of soda ash therefrom.

The invention comprises production of a pregnant liquor, high in sodium bicarbonate values, from Nahcolite mineralization, and more particularly from bedded Nahcolite deposits of the type located in the Green River formation located in the Piceance Creek Basin in Western Colorado, U.S.A. Broadly speaking the process involves use of a hot, barren aqueous liquor (a sodium salts "brine" solution) which is pressurized to prevent the flash-over of the water content thereof into steam because the steam adversely affects the production of the sodium bicarbonate.

Steam causes degradation of Nahcolite into sodium carbonate, and if hot enough, e.g., above 250° F., into $CO_2$ and water. In addition, steam causes breakdown of the kerogen content of the inter-bedded host oil shale and production of liquid and gaseous hydrocarbons, including shale oil, therefrom. The result is a contaminated brine which has substantial quantities of hydrocarbons in various forms (liquids, vapors and gummy heavy hydrocarbons) which hinder the crystallization and production of valuable sodium bicarbonate from the pregnant liquor. The presence of such kerogen-derived hydrocarbons extracted by steam causes many problems during crystallization, ranging for example from frothing in the crystallizer to molecular blockage of preferred crystal growth, and contamination of the bicarbonate crystals with hydrocarbons. It also results in the emission of hydrocarbon vapors from the pregnant liquor upon de-gassing when the pressure is relieved from the pregnant liquor after being withdrawn from the underground formation. Accordingly, Applicants, process is controlled to substantially eliminate degradation of Nahcolite and $NaHCO_3$, and eliminate production of kerogens and other hydrocarbons.

The process is characterized by the following steps, considered at steady state conditions after the initial start-up which employs fresh water as the start-up leaching solvent:

(a) A barren aqueous liquor containing substantially no NaOH, low $Na_2CO_3$ (0.5–4% by weight, preferably below about 2.5%), being undersaturated with respect to $NaHCO_3$ (below about 10%) and NaCl (typically 0.5–1%, preferably as low as possible, and ranging from 0.25 to a maximum of about 6%), is heated to a temperature within the range of about 85° to 300° F., pressurized from 50 to 200 psig, and pumped down the injection well to be delivered into the formation (Nahcolite bed) at a temperature of below about 250° F.;

(b) The solution is then circulated between the injection well and a production well by way of communication established between those two wells, while the cavity is maintained at a temperature in the range of from about 80° F. to about 200° F. (preferably 125°–190° F.);

(c) Pregnant liquor is withdrawn from the production well at a pressure in the range of 10 to 50 psig and a temperature in the range of from about 80° F. to about 200° F. (preferably 125°–190° F.);

(d) The rate of injection and withdrawal is maintained in balance where the two wells are in communication with themselves and there are no other sources of fluid loss. Pumps supply the dynamic pressure to move the fluid through the cavities. Where there is an imbalance in the input vs. the output, it is evidence of a solution loss which should be avoided;

(e) The temperature values are maintained on the injection fluid side sufficiently high to compensate for the thermal loss in the ever-enlarging cavity;

(f) Air pressure in the annulus between the injection tubing string and its casing, and between the production tubing string and its casing in the production well, provides heat insulation reducing heat loss during injection and extraction. The static pressure of the liquor in the wells is sufficient to maintain the pressure in the cavity high enough to prevent the hot leaching solution from flashing over to steam; and (g) The rate of fluid flow through the dissolution cavity is maintained sufficient to provide for an increase in bicarbonate concentration on order of from 3–20% of sodium bicarbonate in the pregnant liquor as compared to the barren injection liquor. The pregnant liquor ranges from 100 to 240 g/L $NaHCO_3$ while the barren reinjection liquor ranges from 60 to 130 g/L $NaHCO_3$.

(h) The resultant pregnant liquor has typically less than about 1% NaCl (range 0.25–6%), about 2% $Na_2CO_3$ (range 0.5–4%) and about is substantially devoid of sodium sulfate and sodium borate. It is quite different from the natural brines available at Owens Lake or Searles Lake in California, or other natural lake brines.

The wells are paired, and cross-over valves are provided and controlled so that the two wells serve alternately as injection and production wells. This promotes even cavity growth, and prevents scaling in the injection and production pipe string. The wells are initially established by conventional drilling, installation of casing, cementing between the casing and bore hole, and installation of the injection and production pipe C string with appropriate spacers. The horizontal connection between the wells is established by fracing (either explosive or hydro-fracing), by horizontal drilling or by undercutting. The drilling, and fracing procedures are conventional. The undercutting technique is particularly useful to produce sodium bicarbonate from single cavities from a single cased drill hole having both injection and production tubing strings. This invention process covers both single hole and multiple connected hole operations.

Comparison of surface pregnant liquor pressure to surface air pressure indicates the air/liquor interface location. Alternately wire line logging may be employed to ascertain the height of the fluid up from the top of the cavern. If there is excess roof collapse, or a prospect of such roof collapse, the cavern can be pressurized with air so that an air layer is provided in the top of the cavern, thus preventing the leaching solution from continued upward dissolution, thereby preserving the cavern roof. Continued liquor flow through the cavity during use of the air layer permits lateral cavity expansion by preferential dissolution of the cavity walls, i.e. undercutting.

The process of producing sodium bicarbonate or sodium carbonate products from the hot pregnant liquor proceeds as follows:

(a) The pregnant liquor exiting the production well is first degassed by relieving the pressure to atmospheric by passing into a holding/degassing tank;

(b) The pregnant liquor is then passed to a crystallizer, preferably an Oslo-type crystallizer, which operates at atmospheric pressure and has an open top;

(c) The liquor is cooled to a temperature within the range of from about 25° to about 120° F., preferably within the range of 60°–80° F. to effect the crystallization, preferably by withdrawing a portion of the liquor from the bottom of the crystallizer, passing it through a cooling unit, and returning it into the crystallizer typically the liquor is cooled by about 15°–125° F., to below about 120° F., preferably below about 80° F.;

(d) Crystallization is either self-initiated, or can be initiated by introduction of seed crystals. Once crystallization commences, there is always present in the crystallizer sufficient seed crystals to continue crystallization under steady state conditions;

(e) As crystallization proceeds, a portion of the liquor being withdrawn from the bottom of the crystallizer is tapped off as product slurry and passed to a centrifuge;

(f) Water is removed by centrifugation; and (g) The damp crystal product on the centrifuge basket is then removed and dried. The resulting dry product is a high purity sodium carbonate typically on the order of 98+% $NaHCO_3$, and is also very low in chloride, on the order of less than 0.1%, and $Na_2CO_3$, typically less than 1%. Chloride, being present only on the surface, can be easily washed off.

If desired, the sodium bicarbonate can be processed by calcining to produce soda ash. A variety of soda ash products can be produced. If the sodium bicarbonate crystals are calcined once, they produce a very light soda ash on the order of 20–25 lbs. per cubic foot (herein Light Ash, abbreviated LA). In the alternative, a portion of the once-calcined soda ash can be sprayed with water, mixed with sodium bicarbonate and calcined to produce soda ash having a density on the order of 30–40 lbs. per cubic foot (herein called Medium Ash, abbreviated MA). In the alternative, the once-calcined soda ash can be introduced into a slurry tank where it is formed into an aqueous slurry and dried to produce soda ash having a density on the order of 55 lbs./cubic foot (herein called Dense Ash, abbreviated DA).

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

GEOLOGIC DESCRIPTION OF THE NAHCOLITE BED MINED

The experimental work underlying this invention occurred on a federal sodium lease area in the Piceance Creek basin in the western slope of Colorado. The location was very near the depocenter of the basin where oil shale and saline mineral deposition reach maximum thickness. Rocks in place at the surface comprised Units 4 and 5 of the Unita Formation, which is underlain by the Green River Formation. The upper-most of the three members in the Green River Formation is the Parachute Creek Member, which contains the so-called Saline Zone. In this area, the saline facies of the Parachute Creek Member is nearly 1,100', thick. Nahcolite and other saline minerals, along with oil shale, occur below the dissolution surface at the base of the leach zone, which in turn is about 300, to 400, below the rich oil shale- containing Mahogany Zone. The dissolution surface, at its lowest point near the basin depocenter lies from 1,500 to 1,900' below the surface of the sodium lease area. The saline facies include 20 or more intervals of saline mineral deposits of 5' or more in thickness containing 40% or more Nahcolite. The total estimated Nahcolite resource within the boundaries of the 8222 acre lease area is in excess of 6 billion tons.

Generally speaking, the Mahogany Zone, which contains the rich oil shale, starts at approximately 1,300', to approximately 1,450' below the surface, and has a thickness of about 175'. Immediately therebelow is a leached zone, extending down to approximately 1,800'. This leached zone contains the Lower Aquifer. The Upper Aquifer is above the Mahogany Zone. This zone is considered hydrologically as a leaky confining bed. Just below the dissolution surface of the Saline Zone is the Upper Salt interval which is approximately 40' to 80' thick. In the upper salt interval is a series of so-called Rubber Beds, oil shale, Nahcolitic oil shale, and Nahcolite beds.

Nahcolite occurs in varying forms that have been classified as follows:

- Type 1: Aggregates in non-bedded course-crystalline form which are scattered throughout the oil shale, amounting to 66% of total Nahcolite reserves;
- Type 2: Crystals in fine-grain laterally continuous form disseminated throughout the oil shale for about 21% of the total;
- Type 3: Microcrystalline, brown Nahcolite present in nondiscrete laminae and beds;
- Type 4: Course-grained, white Nahcolite in beds of varying thickness; and
- Types 3 and 4 are present in approximately 13% of the total. The disseminated crystalline Nahcolite Type 2, may grade laterally into bedded brown microcrystalline Nahcolite Type 3 or Nahcolite aggregates of Type 1.

The Nahcolite of interest in this research was the Boies Bed, which is a high grade bedded interval of Nahcolite that occurs near the top of the saline zone. The bed varies from 30 to nearly 70' thick in the sodium lease area with average Nahcolite content of 80% or more. At the particular location of the well holes, the Boies Bed had a height of 32' and a Nahcolite content in excess of 80% over that entire height. However, the solution mining was confined to the upper 23–26' which was of higher grade and had thinner Nahcolitic oil shale partings. There was approximately 25' to 30' of competent roof rock above the bed. This roof rock separates the Boies Bed from a zone approximately 330' thick lying there above, which is comprised of profuse occurrences of fractures, joints, collapse breccias, and the above-mentioned Lower Aquifer. FIG. 2 shows the location of the mining zone within the Boies Bed at the site, considered transverse to a line intersecting the injection and production wells shown in FIG. 1. Available data for the stratigraphic top of the Boies Bed indicates that it varies laterally, from depths approximately 1748' to 1922' while the base of the injection zone is at depths ranging from 1773', to 1981'.

Well Emplacement

Both holes were drilled at $7\frac{7}{8}''$ diameter and emplaced with a $5\frac{1}{2}''$ inside diameter casing. The annulus between the outside of the casing and the drill hole was cemented from the surface down to the top of the Boies Bed. The production hole was drilled to a depth of 1,849.5'. The injection well was surface-positioned 75' away and drilled to a depth of 1,857'. Due to borehole drift during drilling the injection and production points were about 110' apart. The production well was fractured in the Boies Bed resulting in a vertical fracture plane emanating from either side of the well as two opposed lobes. The injection well was located so that a horizontal drain hole could be drilled from it to intercept one of the production well fracture lobes at a right angle. The vertical injection well was horizontally drilled for 110' and one lobe from the hydraulic fracture from the production well was intercepted. Communication was well established. Indeed, modest communication was made only 12' from the injection well after hydraulic fracture of the production well, and the horizontal drilling extended some 28' past the main fracture interception. Both wells were emplaced with Nominal $1\frac{1}{4}''$ piping for the injection of barren liquor and withdrawal of pregnant liquor.

Figure 2:
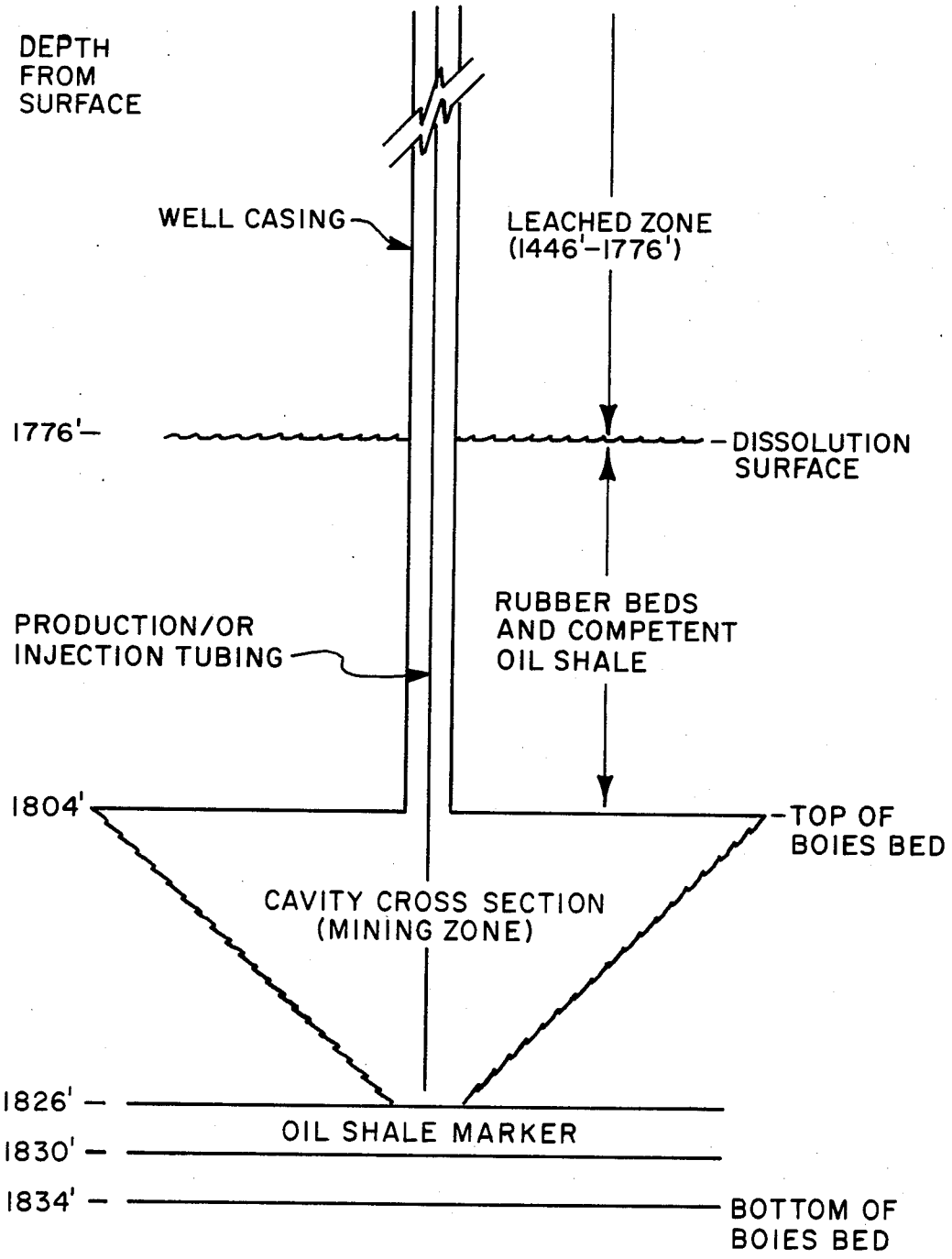
FIG. 2 is a schematic section view of a borehole and solution mined cavity in accord with the invention.

The above ground crystallization plant, well piping and control valving was completed (except for the soda ash production circuit) as shown in FIG. 1, and startup commenced. Initially, cold water was circulated in the solution mining and processing loop. It took approximately one day to bring the cavity to operational temperature and produce the first sodium bicarbonate product. The initial bicarbonate product was a fine white crystal and assayed in excess of 98% sodium bicarbonate. As described in more detail below, approximately 165 tons of high purity sodium bicarbonate was produced during the test phase. The sodium bicarbonate on a dry basis exceeded 99% $NaHCO_3$ with about 20–25 parts per million of heavy metal contaminants. This is well below the permitted similar contaminant content for animal feeds as approved by the Association of American Feed Control Officials, Inc. Thus, the product qualifies as an animal feed on an as-produced basis. An additional simple wash of the $NaHCO_3$ crystals further increase the purity by decreasing heavy metal and other contaminants.

During the operations, the wet annulus (which is the flooded lower section of the annulus between the injection tubing or extraction tubing and its casing) was monitored. The annulus above the wet section was filled with compressed air at pressures on the order of 750–900 psig, typically 760–840 psig. Typically the wet annulus surrounding the injection well tubing was below that of the extraction or production well string due to higher air temperature. The heat loss in therms per minute ranged throughout the test work from 10.3 to 15.1 therms per minute. Generally speaking, the cavity temperature was maintained at approximately 190° F. by injection of hot barren liquor in the temperature range (at the point of injection at the bottom of the bed) below about 250° F., preferably 85°–235° F., with 150°–210° F. being most preferred, with a dynamic pressure below about 200 psig, preferably in the range of from 45–150 psig (at wellhead), to hold $CO_2$ in solution and prevent flashing to steam (for temperatures above ambient boiling). The flow rate was limited by the crystallization process equipment and ranged from approximately 5 to about 20 gallons per minute. Several hundred gpm can be circulated to saturation in a full-production stage cavity, even for the 110, spacing of the test well injection and production points in the Boies Bed. For injection and production points spaced further apart, and/or for different surface processing capacity, the flow rate would change and could be increased significantly.

The input hot barren liquor contained approximately 7–10% dissolved Nahcolite, less than 1% dissolved sodium chloride and about 2% sodium carbonate. The pregnant liquor extracted at the same flow rate contained 12–15% dissolved Nahcolite and no increase in dissolved sodium carbonate and sodium chloride. The $\Delta T$ between wells was 30°–60° F., and the dynamic pressure $\Delta P$ was 20–60 psig. The pregnant liquor from the extraction well was cooled to approximately 25°–120° F. in the crystallizer, resulting in preferential precipitation of the bicarbonate crystals without halite precipitation. There was no problem with buildup of excess concentration of halite as the Nahcolite in the Boies Bed is very low in Halite, on the order of 0.35% chloride weight basis. Colder crystallization temperatures produce more bicarbonate. Based on our work here we prefer crystallization in the range below 100° F., preferably from about 60° F. to about 80° F.

Table I below shows typical dissolved salts content in weight percent for both barren and pregnant liquor samples in accord with this invention.

TABLE I

| | Typical Liquor Characteristics | | | |
|---|---|---|---|---|
| | Temp | Dissolved Salts Content in % | | |
| Liquor Type | °F. | $NaHCO_3$ | $Na_2CO_4$ | Balance |
| Barren | 60 | 8 | 2 | 0.5 |
| Pregnant | 160 | 16 | 2 | 0.5 |
| Pregnant | 200 | 20 | 2 | 0.5 |

As shown in FIG. 1, the injection occurs near the floor of the bed to undermine by dissolution (undercut) the Nahcolite thereabove. This minimizes premature cavity shutdown caused by liberated insolubles shielding the Nahcolite from solution contact, as would be the case by injection at the top of the cavity. As shown in FIG. 1, the dashed line marked "A.I.C." in the dissolution cavity represents a condition where air is pumped into the dissolution cavity to that level to protect the roof in the event of conditions where the roof may be less competent and it is desired to protect the roof from the solution action of the liquor in the bed. Note the production well string is also well down in the cavity. An air blanket is also used for undercutting. The Nahcolite can be undercut without collapse. The cavity growth is flow-rate limited, rather than surface area limited during most of the cavity life.

Bulk Sample Pilot Test Work

In order to test the process a bulk sample pilot plant was set up as shown in FIG. 1. A series of tests resulted in approximately 165 tons of high quality sodium bicarbonate produced from the dissolution cavity in the Boies Bed described above.

Referring now to FIG. 1, barren liquor from the production well tubing (1) was supplied to a de-gassing tank (2) wherein the pressure was relieved in the pregnant liquor. The pressure on the production side was approximately 30 psig, and some $CO_2$ came out of solution. The solution temperature ranged from about 110° F. to about 160° F., and was passed via line 3 to crystallizer 4. The liquor in the crystallizer 4 was cooled to about 25°–120° F. by passing it through the recycle loop 5, wherein the liquor was cooled in cooling unit 6 before being returned via line 7 to the crystallizer. At steady state condition the crystallizer was approximately 100° F., and self-initiated $NaHCO_3$ crystallization occurred within the crystallizer. A portion of the resulting crystal slurry passing through the recycle loop 5 was withdrawn via line 8 to a centrifuge 9. The damp sodium bicarbonate crystal product 10 collected on the centrifuge basket was then transferred to dryer 11 to produce the end product high-quality sodium bicarbonate 12.

If desired, the sodium bicarbonate product can be calcined in calciner 13 to form a very light ash product 14 having a density on the order of 20–25 lbs./cubic foot. If a more dense ash is desired, the once-calcined product can be transferred via line 15 to a water spray 16 and re-calcined in the calciner to produce a light or medium dense ash 17 having a density on the order of 30–40 lbs/cubic foot. If an even denser ash is desired, the once-calcined soda ash may be passed via line 18 to a slurry tank 19, and thence to a centrifuge 20. The damp, hydrated product 21 is passed through a dryer 22 to produce a dense soda ash 23 having a density on the order of 55 lbs./cubic foot.

The underflow 24 from the centrifuge 9 is the barren liquor. It is reheated at 25 and pumped back down the injection well tubing 26 for further dissolution of the Nahcolite in the cavity, whereupon the procedure is repeated. Makeup water may be added at 27, which is typically upstream of the heater 25. Periodically, the valves 28 and 29 are closed, and the cross over valve 30 is opened to permit reversing of the flow through the well tubings. While one cross-over valve 30 is shown for simplicity of illustration, cross-over typically is accomplished by a pair of valves, one in each of the cross-over lines. This promotes more even dissolution in the cavity and prevents the plugging of the production well string. The dissolution cavity temperature generally equilibrated at approximately 190° F.

Table II below shows in Examples 1–8 a series of 8 periods ranging from $1\frac{1}{4}$–$1\frac{3}{4}$ days of operation of the two wells and surface crystallization equipment. Table II shows the injection rates, temperatures and pressure for both the injection and production wells. In addition it shows in the column marked "I-P values" the temperature differential and pressure differentials between the two wells at the well heads. In addition, the amount of sodium bicarbonate production during each run is listed in the table. The injection well temperature figures range from 242°-296° F., and are the temperatures measured just downstream of the heater for injection down the injection well tubing. The actual delivery temperature to the cavity is approximately 50° F. less than the figures shown in Table II under the injection well temperature heading.

TABLE II

| | | SOLUTION MINING TEST EXAMPLES | | | | | | | | |
|---|---|---|---|---|---|---|---|---|---|---|
| | Test | Injection Well* | | | Production Well* | | | I-P Value | | |
| Ex. | Period Days | FR, GPM | T, °F. | P psig | FR, GPM | T, °F. | P psig | ΔT °F. | ΔP psig | $NaHCO_3$ Tons |
| 1. | 1.25 | 11.9 | 245 | 96 | 12.6 | 112 | 31 | 133 | 65 | 3.7 |
| 2. | 1.5 | 14.1 | 242 | 107 | 15.2 | 127 | 28 | 115 | 79 | 5.0 |
| 3. | 1.5 | 10.1 | 258 | 93 | 12.2 | 131 | 38 | 127 | 55 | 2.3 |
| 4. | 1.75 | 11.3 | 259 | 96 | 13.3 | 131 | 24 | 128 | 72 | 3.9 |
| 5. | 1.5 | 7.8 | 288 | 79 | 10.2 | 124 | 21 | 164 | 58 | 2.5 |
| 6. | 1.5 | 11.6 | 274 | 116 | 16.1 | 121 | 30 | 153 | 86 | 3.3 |
| 7. | 1.5 | 13.2 | 286 | 108 | 14.2 | 146 | 26 | 140 | 82 | 6.0 |
| 8. | 1.25 | 12.7 | 296 | 126 | 14.3 | 151 | 27 | 145 | 99 | 5.2 |

*Wet annulus air pressure about 800 psig.
FR, GPM = Flow Rate in Gallons/Minute
Temperatures shown are at wellhead.
P and ΔP refers to dynamic pressure.

The resulting sodium bicarbonate was in the form of fine crystals, 100% minus 500 mesh, and assayed over 98% $NaHCO_3$. It is suitable as an animal feed supplement in the as-produced condition as it contains less than 30 parts per million heavy metals (predominantly: Ba, Zn, Ni, Ti, V, Sc, I and B; excluding Fe). Table III below shows typical assays of the end product sodium bicarbonate.

TABLE III

| End Product Sodium Bicarbonate Assays | | |
|---|---|---|
| Assay | Sample 1 | Sample 2 |
| $NaHCO_3$ (Dry Basis) | 99.46% | 99.8% |
| $Na_2CO_3$ | .4% | 1.08% |
| NaCl | .15% | .20% |
| $Na_2SO_4$ | .02% | 300 ppm |
| Fe | 132 ppm | 20-21 ppm |
| Water Insoluble | .28% | .02% |
| Heavy Metals (as PG) | 20-25 ppm | — |
| Heavy Metals* | — | 17.3 |
| Density (Loose) | 760 gl | 781 |
| pH | — | 8.33 |

*(Ba, I, Ag, Nb, Sr, Rb, Se, Ge, Ga, Zn, Cu, Ni, Co, Mn, Cr, V, Ti, Sc, B)

Washing significantly reduces inorganic impurities. In addition, the finely powdered crystalline bicarbonate was suitable for air pollution control, particularly flue gas desulfurization and removal of $NO_x$.

Figure 3:
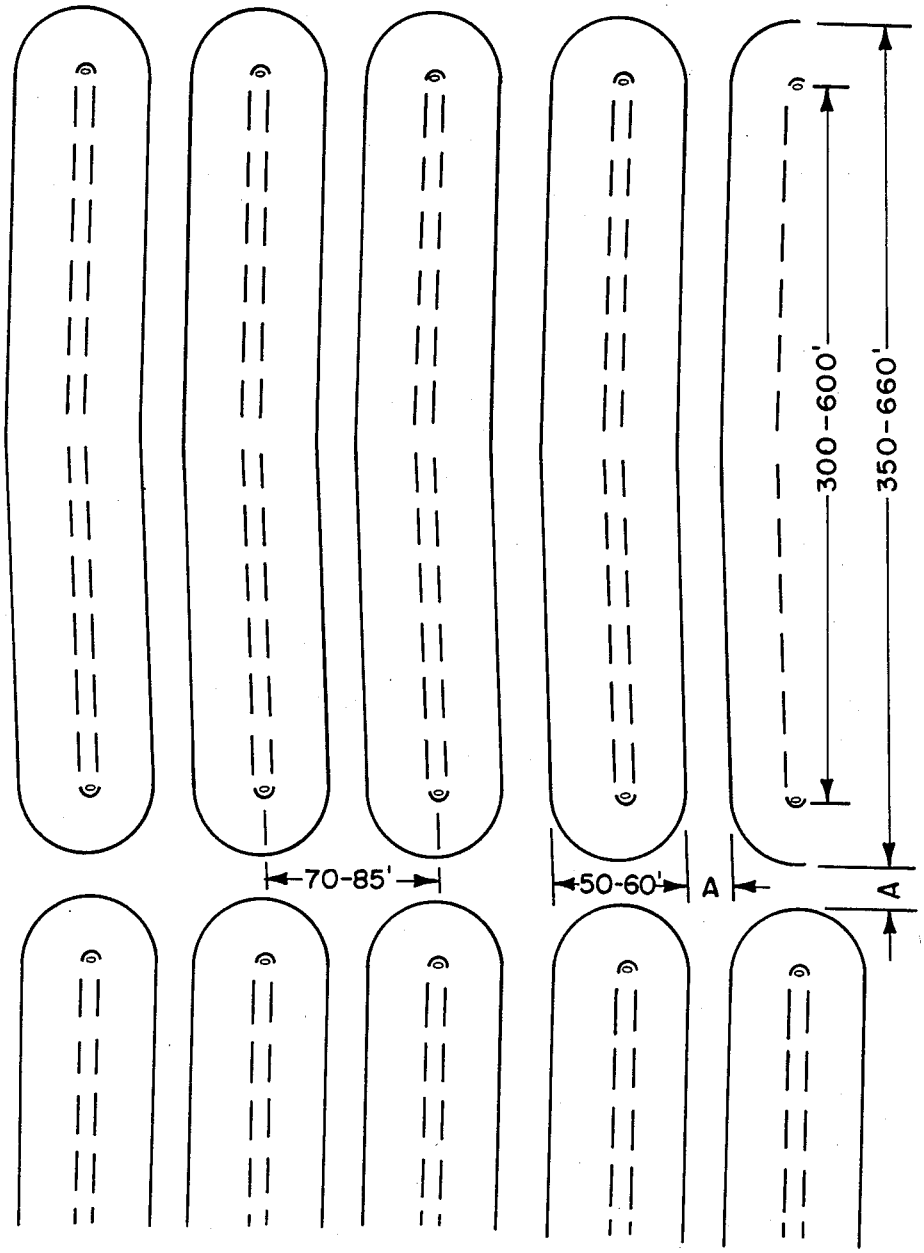
FIG. 3 is a schematic plan view of a full production field layout in accord with the invention.

A full production mining cavity layout is shown in FIG. 3. In that figure, the paired production and injection wells are spaced 300-600' apart for communication along a generally stadium shaped mining cavity which is developed. Adjacent mining cavities are spaced on 70-85' centers, with solution mining extending approximately 25-30' outwardly from each of the wells. As shown by dimension "A" in FIG. 3, this leaves a 20-30' pillar between adjacent mined dissolution cavities, thus preventing substantial surface subsidence. As noted in FIG. 2, the normal dissolution cavities (mined by the process of this invention without undercutting being employed) form an inverted triangle with an angle of repose of around 45°. The width of the cavity at the top is about 50-100' and its height is approximately 23'-26' with adjacent cavities forming rib pillars there which are 20-30' wide at the top and 60-70' at the bottom to provide support to the overlying rocks. Extraction from a given cavity is stopped when the planned volume is attained, or if upward solution activity breaches the roof rocks which lets cavity liquor escape to the Lower Aquifer thereabove.

It should be understood that the maximum cavity size developed depends on roof mechanics as determined from analysis and field experience, but typically ranges from 50-60' in width. The Nahcolite can be undercut to avoid a "Morning Glory" cavity shape. Gas lift and/or submersible pumps can be used in the extraction wells to aid in withdrawing pregnant liquor, but our experience is that the ΔP of 30-60 psig is sufficient to establish good dissolution flow rates through the cavity and lift the pregnant liquor out the production string. For 300' spacing of wells the recovery will be some 12,000 tons, about 35% of reserves. For 600' spacing, the recovery will be about 37.5%. By use of undercutting and horizontal drilling techniques the recovery at 300' spacing can be doubled to 24,000 tons and recovery of up to 60%, but the pillar dimensions should be increased by a few feet as compared to non-undercut operations. The flow rate per well pair would be about 800 gpm of 160° F. barren liquor (about 27,000 Bbl/day water; 42 gal/BBL). For 300' well spacings, a maximum of three cavities would be operated at any one time, and for 600' spacing, two cavities simultaneously, to produce 50,000 TPY high grade sodium bicarbonate.

It should be understood that various modifications within the scope of this invention can be made by one of ordinary skill in the art without departing from the spirit thereof. We therefore wish our invention to be defined by the scope of the appended claims as broadly as the prior art will permit, and in view of the specification if need be.

We claim:

1. Nahcolite solution mining process comprising, in operative sequence at steady state conditions, the steps of:

(a) injecting a hot barren aqueous liquor under superatmospheric pressure of less than about 150 psig at the wellhead into a Nahcolite bed;

(b) said barren liquor having concentration below about 10% $NaHCO_3$, below about 6% NaCl, and from about 0.5-4% $Na_2CO_3$;

(c) circulating said liquor in said bed to form a cavern therein;

(d) maintaining said liquor in said cavern at a temperature of below about 250° F.;

(e) continuing said circulation of said liquor in said bed cavern for a time sufficient to produce a pregnant liquor having an increase in concentration of said $NaHCO_3$ into the range of from about 10% to 25% while maintaining said NaCl and $Na_2CO_3$ concentration below said values;

(f) removing said pregnant liquor from said bed;

(g) extracting $NaHCO_3$ from said pregnant liquor to produce said barren liquor and sodium bicarbonate.

2. Nahcolite solution mining process as in claim 1 wherein the increase in said $NaHCO_3$ concentration in said pregnant liquor as compared to said barren liquor ranges from about 3% to about 15%.

3. Nahcolite solution mining process as in claim 2 wherein said liquor in said cavity is maintained at a temperature below about 200° F.

4. Nahcolite solution mining process as in claim 3 wherein said liquor in said cavity is maintained at a temperature in the range of from about 125° F. to about 190° F.

5. Nahcolite solution mining process as in claim 4 wherein said NaCl concentration is maintained below about 1.0%.

6. Nahcolite solution mining process as in claim 5 wherein said $Na_2CO_3$ concentration is maintained below about 2.5%.

7. Nahcolite solution mining process as in claim 1 wherein said $NaHCO_3$ is extracted from said pregnant liquor by crystallization upon cooling.

8. Nahcolite solution mining process as in claim 7 wherein said pregnant liquor is cooled during said crystallization step into the range of from about 25°–120° F.

9. Nahcolite solution mining process as in claim 8 wherein pressure is relieved from said pregnant liquor prior to cooling crystallization.

10. Nahcolite solution mining process as in claim 8 wherein said sodium bicarbonate is produced in the form of fine crystals of 98+% $NaHCO_3$.

11. Nahcolite solution mining process as in claim 10 wherein said $NaHCO_3$ crystals are washed to produce a purified sodium bicarbonate.

12. Nahcolite solution mining process as in claim 10 wherein said $NaHCO_3$ is calcined to produce soda ash.

13. Nahcolite solution mining process as in claim 12 wherein said produced soda ash has a bulk density in the range of from 20–55 lbs/cu ft.

14. Nahcolite solution mining process as in claim 3 wherein said $NaHCO_3$ is extracted from said pregnant liquor by crystallization upon cooling.

15. Nahcolite solution mining process as in claim 14 wherein said pregnant liquor is cooled during said crystallization step into the range of from about 25°–120° F..

16. Nahcolite solution mining process as in claim 15 wherein pressure is relieved from said pregnant liquor prior to cooling crystallization.

17. Nahcolite solution mining process as in claim 15 wherein said sodium bicarbonate is produced in the form of fine crystals of 98+% $NaHCO_3$.

18. Nahcolite solution mining process as in claim 17 wherein said $NaHCO_3$ crystals are washed to produce a purified sodium bicarbonate.

19. Nahcolite solution mining process as in claim 18 wherein said $NaHCO_3$ is calcined to produce soda ash.

20. Nahcolite solution mining process as in claim 19 wherein said produced soda ash has a bulk density in the range of from 20–55 lbs/cu ft.

21. Nahcolite solution mining process as in claim 5 wherein said $NaHCO_3$ is extracted from said pregnant liquor by crystallization upon cooling.

22. Nahcolite solution mining process as in claim 21 wherein said pregnant liquor is cooled during said crystallization step into the range of from about 25°–120° F.

23. Nahcolite solution mining process as in claim 22 wherein pressure is relieved from said pregnant liquor prior to cooling crystallization.

24. Nahcolite solution mining process as in claim 22 wherein said sodium bicarbonate is produced in the form of fine crystals of 98+% $NaHCO_3$.

25. Nahcolite solution mining process as in claim 24 wherein said $NaHCO_3$ crystals are washed to produce a purified sodium bicarbonate.

26. Nahcolite solution mining process as in claim 25 wherein said $NaHCO_3$ is calcined to produce soda ash.

27. Nahcolite solution mining process as in claim 26 wherein said produced soda ash has a bulk density in the range of from 20–55 lbs/cu ft.

28. Nahcolite solution mining process as in claim 1 wherein said barren liquor is reheated to a temperature sufficient to maintain said cavity liquor temperature, and said reheated barren liquor is reinjected into said Nahcolite bed.

29. Nahcolite solution mining process as in claim 3 wherein said barren liquor is reheated to a temperature sufficient to maintain said cavity liquor temperature, and said reheated barren liquor is reinjected into said Nahcolite bed.

30. Nahcolite solution mining process as in claim 7 wherein said barren liquor is reheated to a temperature sufficient to maintain said cavity liquor temperature, and said reheated barren liquor is reinjected into said Nahcolite bed.

31. Nahcolite solution mining process as in claim 9 wherein said barren liquor is reheated to a temperature sufficient to maintain said cavity liquor temperature, and said reheated barren liquor is repressurized and reinjected into said Nahcolite bed.

32. Nahcolite solution mining process as in claim 16 wherein said barren liquor is reheated to a temperature sufficient to maintain said cavity liquor temperature, and said reheated barren liquor is repressurized and reinjected into said Nahcolite bed.

33. Nahcolite solution mining process as in claim 23 wherein said barren liquor is reheated to a temperature sufficient to maintain said cavity liquor temperature, and said reheated barren liquor is repressurized and reinjected into said Nahcolite bed.

34. Nahcolite solution mining process as in claim 1 which includes the steps of:

(a) establishing at least two wells into said Nahcolite bed, a first and a second well;

(b) forming a physical communication between said two wells; and (c) circulating said liquor in said bed between said wells, said first well being an injection well into which said hot barren liquor is injected, and said second well being a production well from which said pregnant liquor is removed.

35. Nahcolite solution mining process as in claim 34 which includes the added step of periodically switching said first and said second well so that said second well is the injection well and said first well is the production well to reduce the incidence of plugging in said production well.

36. Nahcolite solution mining process as in claim 1 wherein said hot barren liquor is introduced at the base of said Nahcolite bed.

37. Nahcolite solution mining process as in claim 34 wherein said hot barren liquor is introduced at the base of said Nahcolite bed.

38. Nahcolite solution mining process as in claim 35 wherein said hot barren liquor is introduced at the base of said Nahcolite bed.

39. Nahcolite solution mining process as in claim 36 wherein said Nahcolite bed is undercut by providing an air blanket above the cavity liquor level.

40. Nahcolite solution mining process as in claim 37 wherein said Nahcolite bed is undercut by providing an air blanket above the cavity liquor level.

41. Nahcolite solution mining process as in claim 38 wherein said Nahcolite bed is undercut by providing an air blanket above the cavity liquor level.

42. Nahcolite solution mining process as in claim 34 wherein said communication is established by a step selected from fracing, horizontal drilling, undercutting, and a combination thereof.

43. Nahcolite solution mining process as in claim 35 wherein said communication is established by a step selected from fracing, horizontal drilling, undercutting, and a combination thereof.

44. Nahcolite solution mining process as in claim 36 wherein said communication is established by a step selected from fracing, horizontal drilling, undercutting, and a combination thereof.

45. Nahcolite solution mining process as in claim 39 wherein said communication is established by a step selected from fracing, horizontal drilling, undercutting, and a combination thereof.

46. Nahcolite solution mining process as in claim 1 which includes the steps of:

(a) establishing a single well into said Nahcolite bed;
(b) injecting said barren liquor into said bed adjacent the bottom thereof;
(c) establishing an air layer above the level of said liquor in said cavern;
(d) enlarging said cavern by under-cutting said Nahcolite bed; and
(e) withdrawing said pregnant liquor out of said cavern via said single well.

* * * * *